United States Patent [19]

Kamille

[11] Patent Number: 4,756,532

[45] Date of Patent: Jul. 12, 1988

[54] PLAYING SURFACE WITH ANSWERS IN FIRST FIELD PROVIDING ANSWER IN SECOND FIELD

[75] Inventor: Stuart J. Kamille, Atlanta, Ga.

[73] Assignee: Promotional Marketing Corporation, Westport, Conn.

[21] Appl. No.: 19,300

[22] Filed: Feb. 26, 1987

[51] Int. Cl.[4] ..... A63F 9/06

[52] U.S. Cl. ..... 273/153 R; 434/327

[58] Field of Search ..... 273/153 R; 434/327, 434/363

[56] References Cited

U.S. PATENT DOCUMENTS 4,215,864 8/1980 Nichols ..... 273/153 R

OTHER PUBLICATIONS

"Quote-Acrostic", The Washington Post Magazine, p. 42, May 20, 1979.

"Junior Jumble", The Washington Post Comics, Section Section, p. 1, May 20, 1979.

*Primary Examiner*—Anton O. Oechsle

*Attorney, Agent, or Firm*—McAuley, Fields, Fisher, Goldstein & Nissen

[57] ABSTRACT

A game comprises a playing surface having two fields of play. In a first field, a plurality of multiple choice questions are set forth, each choice being identified by a particular symbol. On a second field of play, these symbols are assembled to form a solution which answers a further question. In a preferred embodiment, answers can be selected to the multiple choice questions which will provide an acceptable, but incorrect, answer on the second field of play. In a particular embodiment, the symbols dictated by the choice of the answer to the questions in the first field of play are letters, and the solution formed in the second field of play is a word.

6 Claims, 1 Drawing Sheet

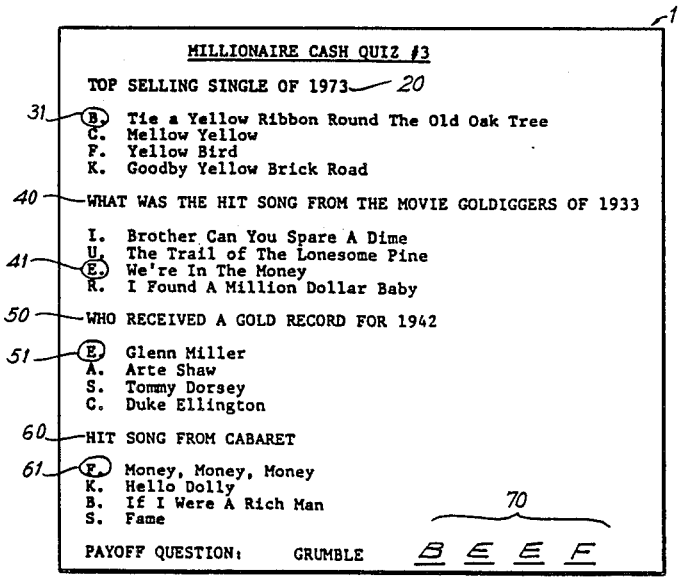

FIG. 1

1

MILLIONAIRE CASH QUIZ #3

TOP SELLING SINGLE OF 1973 — 20

21 — B. Tie a Yellow Ribbon Round The Old Oak Tree
22 — C. Mellow Yellow
23 — F. Yellow Bird
24 — K. Goodby Yellow Brick Road

WHAT WAS THE HIT SONG FROM THE MOVIE GOLDIGGERS OF 1933

I. Brother Can You Spare A Dime
U. The Trail of The Lonesome Pine
E. We're In The Money
42 — R. I Found A Million Dollar Baby

10

WHO RECEIVED A GOLD RECORD FOR 1942

E. Glenn Miller
52 — A. Arte Shaw
S. Tommy Dorsey
C. Duke Ellington

HIT SONG FROM CABARET

F. Money, Money, Money
62 — K. Hello Dolly
B. If I Were A Rich Man
S. Fame

11 — PAYOFF QUESTION: GRUMBLE — 70 — _ _ _ _

1

MILLIONAIRE CASH QUIZ #3

TOP SELLING SINGLE OF 1973 — 20

31 — B. Tie a Yellow Ribbon Round The Old Oak Tree
C. Mellow Yellow
F. Yellow Bird
K. Goodby Yellow Brick Road

40 — WHAT WAS THE HIT SONG FROM THE MOVIE GOLDIGGERS OF 1933

I. Brother Can You Spare A Dime
U. The Trail of The Lonesome Pine
41 — E. We're In The Money
R. I Found A Million Dollar Baby

50 — WHO RECEIVED A GOLD RECORD FOR 1942

51 — E. Glenn Miller
A. Arte Shaw
S. Tommy Dorsey
C. Duke Ellington

60 — HIT SONG FROM CABARET

61 — F. Money, Money, Money
K. Hello Dolly
B. If I Were A Rich Man
S. Fame

PAYOFF QUESTION: GRUMBLE — 70 — B E E F

FIG. 2

PLAYING SURFACE WITH ANSWERS IN FIRST FIELD PROVIDING ANSWER IN SECOND FIELD

FIELD OF THE INVENTION

The present invention is directed to a game, particularly a game of skill. While the game is applicable to use as a contest between two or more players, it is most advantageously employed as a promotional game in the field of consumer sales.

BACKGROUND OF THE INVENTION

Contest games have often been used in the retail sales area, and in a variety of ways. Games are used, for example, in the fast food industry as an inducement to prospective customers to patronize a particular establishment or chain of establishments. In such a use, the prizes awarded are generally the products purveyed by the particular establishment, as well as, or in addition to, cash, trips, or other merchandise.

Similarly, games of skill have frequently been used in the promotion of consumer products, either to increase the sales of a particular brand because of the inducement provided by the prizes available through successful completion of the game, or as a means to introduce a new product in, essentially, the same way.

For example, in U. S. Pat. No. 4,466,614, Bachman et al, a game is described with a playing surface having first indicia defining a plurality of game symbols and second indicia on the playing surface defining a plurality of game categories, the second indicia being arranged so that the symbols are in spaced relationship with the categories. Third indicia are provided on the surface to define a plurality of playing areas, and each area is in spaced register with one of the symbols and one of the categories. A desired combination of selected symbols is associated with each category and, in an apparently preferred embodiment, all of the symbols are used.

In order to attract the attention of the consuming public, new forms of games must constantly be developed.

SUMMARY OF THE INVENTION

In accordance with the present invention, a playing surface is provided having two fields of play. In the first field of play, a plurality of multiple choice questions are provided. Each of the choices for each of the questions is identified by a symbol. When the correct selections are made from the several choices, the symbols identified, as associated with each choice, can be combined to provide the answer to a question in a second field of play provided on the playing surface. In a preferred embodiment, incorrect choices can be made in the first field of play which will identify symbols and when those symbols are combined, an answer is also provided which answers a question in the second field of play; however, the answer is incorrect, since the answers selected in the first field of play were incorrect.

The symbols which are designated by selection of an answer are, preferably, letters. In that case, the letters are employed in the second field of play to spell out the word which is, generally, a synonym for another word. When the symbols are letters, the answer provided in the second field of play, while being a synonym for the other word given, may be an incorrect answer because the answers given in the first field of play were incorrect.

When the symbols are letters, the letters provided by the correct answers to the multiple choice questions will answer the "pay off question," and can either be in the correct order, or may be scrambled, to add yet another element of skill to the game. A particular value is assigned to each correctly completed playing surface or card. If desired, all playing surfaces or cards can be given the same value, or those of increased difficulty may have increased point values. Players accumulating the most total points, by whichever system is used, are designated the winners.

BRIEF DESCRIPTION OF THE DRAWINGS

In the accompanying drawings:

FIG. 1 is a representation of a playing surface or card as received by a player; and FIG. 2 is a representation of the playing surface or card of FIG. 1 completed with the correct answers, both to the multiple choice questions and to the "pay off question."

DESCRIPTION OF THE PREFERRED EMBODIMENTS

Referring to the accompanying drawings, and particularly, FIG. 1, a playing surface or card 1 is provided with two fields of play, a first field 10 on which are printed a plurality of multiple choice questions, with several answers, and a second field 11, which is provided with a "pay off question" to be answered based upon the information obtained from a correct solution of the questions in the first area.

As illustrated in FIG. 1, four multiple choice questions are provided. If desired, the number of questions provided can be more, or less, depending upon the length of the answer to be provided in the "pay off question." Obviously, the more multiple choice questions provided in the first area, the more difficult is the ultimate solution of the "pay off question."

Again, referring to FIG. 1, the first question 20, "top selling single of 1973," is provided with four possible answers, 21 through 24; as will be appreciated, each of the possible answers is preceded by a letter. Selection of the correct answer provides the player with the proper letter to be used in solving the "pay off question" in the second field. As will be seen in FIG. 2, the first answer, "Tie a Yellow Ribbon Round the Old Oak Tree," has been selected as the appropriate answer to question 20, so that the letter B, 31, has been provided as the appropriate letter from the first question.

In the same manner, the second question 40 is answered with the third possible selection to provide the letter E, 41; the proper answer to the third question 50 provides the letter E 51; and the proper answer to the fourth question 60 provides the letter F, 61.

The "pay off question" provided in the second area of play 11 is for a four letter synonym for "grumble." The fact that four letters are required for the answer is shown by the provision of four lines in the portion 70 of the playing field. The letters 31, 41, 51, and 61, provided by the correct answers to the questions in the first field of play are placed onto the blanks in the area 70 to provide the proper synonym for "grumble," in this case, "beef." The playing surface or card is now complete and an appropriate point score is awarded for it.

As illustrated in the accompanying figures, the letters obtained by correct answering of the multiple choice questions in the first field appear in the same order as they should appear in the area 70 in the second field. Obviously, to add another dimension of skill to the game, the letters may be "scrambled," so that, in addition to selecting the proper answers, the letters must be unscrambled to provide the answer to the "pay off question." Further, in addition to the relative ease or difficulty of the particular questions, or to the ease or difficulty of the synonym provided in the "pay off question," the entire game may be rendered easier by providing only a three letter answer to the "pay off question," while increased difficulty can be accomplished by providing five or more questions with the corresponding number of correct answers and letters to be used in solving the "pay off question."

As indicated, in a preferred embodiment, answers could be selected on the first field of play which would also provide an acceptable answer to the "pay-off question" in the second field of play, but where the answers in the first field of play would be incorrect. In that regard, and referring to FIGS. 1 and 2, if answer 22 were selected from the first question, the letter "C" would be obtained. Similarly, if 42 were selected as the answer to the second question, 52 as the answer to the third question, and 62 as the answer to the fourth question, then the combined letters would spell "Crab," which would be an acceptable answer to the "pay-off question," "Grumble." However, since the answers 22, 42, 52, and 62 are incorrect, the answer to the "pay-off question" would also be incorrect. Obviously, the provision of a possible second set of answers, but answers which are incorrect, adds yet another level of skill to the game.

The description of the preferred embodiment has obviously described that embodiment where the symbols indicated by selection of an answer are letters. It will be appreciated, without changing the concept of the game or the playing surface, that those letters may be other symbols, such as numbers, pictures, etc. Merely as an example, the symbols could be such that they would identify the four seasons of the year in appropriate order, a sequence of symbols which would illustrate a rising sun, etc. Similarly, the symbol could be numbers and insertion of the numbers in the second field of play could be the answer to some mathematical problem.

When the game surfaces of the present invention are to be employed in a promotional type of game, obviously, they will be single use type of playing surfaces; i.e., the playing surface is submitted to some agency who collects and tabulates the scores. On the other hand, if the playing surfaces or cards are to be used in a contestant type of game, then it may be desirable to form the cards of a washable type of surface, so that, once the answers and scores are tabulated, the answers can be wiped off of the card, and the card reused.

Obviously, whichever type of game the playing surfaces or cards are employed in, there will be a plurality of such cards, each containing different questions and "pay off questions," and, as indicated, the degree of difficulty can be varied.

While specific embodiments of the invention have been shown and described, the invention should not be considered as so limited, but only as limited by the appended claims.

What is claimed as new and desired to be secured by letters patent is:

1. A game comprising a playing surface having two fields of play, the first field of play having printed thereon a series of questions having multiple choice answers, each answer being designated by a particular symbol; the second field of play being provided as a question, the answer to which is supplied by the symbols provided in said first field of play; wherein each symbol is a letter and wherein the letters provided by the answers to the multiple choice questions provide at least two answers for the second field of play, the correct answer and at least one incorrect answer.

2. The game of claim 1 wherein the question in said second field of play is for a synonym.

3. The game of claim 1 wherein the letters provided by the answers in said first field of play are in the same order as the answers to be provided in said second field of play.

4. The game of claim 1 wherein the letters provided in said first field of play are scrambled relative to the order for the answer in said second field of play.

5. The game of claim 1 wherein a plurality of such playing surfaces are provided, each playing surface so provided having different questions in both said first field of play and said second field of play.

6. The game of claim 5 wherein the level of difficulty of the questions varies from surface to surface.

* * * * *